US007681632B2

(12) United States Patent
Wood

(10) Patent No.: US 7,681,632 B2
(45) Date of Patent: Mar. 23, 2010

(54) INTEGRATED TOP DRIVE AND COILED TUBING INJECTOR

(75) Inventor: Thomas Dyer Wood, Calgary (CA)

(73) Assignee: Xtreme Coil Drilling Corp., Calgary, Alberta (CA)

( * ) Notice: Subject to any disclaimer, the term of this patent is extended or adjusted under 35 U.S.C. 154(b) by 0 days.

(21) Appl. No.: 12/093,958

(22) PCT Filed: Nov. 16, 2006

(86) PCT No.: PCT/US2006/044500

§ 371 (c)(1),
(2), (4) Date: May 16, 2008

(87) PCT Pub. No.: WO2007/061747

PCT Pub. Date: May 31, 2007

(65) Prior Publication Data

US 2008/0314580 A1 Dec. 25, 2008

Related U.S. Application Data

(60) Provisional application No. 60/737,611, filed on Nov. 17, 2005.

(51) Int. Cl.
*E21B 19/22* (2006.01)

(52) U.S. Cl. ..... 166/77.1; 166/77.2; 166/85.5

(58) Field of Classification Search ..... 166/76.1, 166/77.2, 85.5
See application file for complete search history.

(56) References Cited

U.S. PATENT DOCUMENTS

| | | | | |
|---|---|---|---|---|
| 5,809,916 | A * | 9/1998 | Strand | 166/77.2 |
| 6,003,598 | A | 12/1999 | Andreychuk | |
| 6,408,955 | B2 | 6/2002 | Gipson | |
| 6,609,565 | B1 | 8/2003 | Andreychuk et al. | |
| 2004/0020639 | A1 | 2/2004 | Saheta | |
| 2004/0206551 | A1 | 10/2004 | Carriere et al. | |
| 2007/0284113 | A1 * | 12/2007 | Haheim | 166/345 |

* cited by examiner

*Primary Examiner*—David J Bagnell
*Assistant Examiner*—Elizabeth C Gottlieb

(57) ABSTRACT

An apparatus for conducting earth borehole operations, comprising a base, a mast mounted on the base, and an integrated unit comprising a top drive and a coil tubing injector carried by the mast for longitudinal movement therealong. The top drive has an opening therethrough whereby coil tubing from the injector can pass through the top drive. There is a guide for coil tubing, the guide being selectively releasably connected to the coil tubing injector and mounted on the mast and selectively movable between a first position wherein coil tubing from the guide can be stabbed into the injector and a second position wherein coil tubing from the guide is out of alignment with the coil tubing injector.

4 Claims, 5 Drawing Sheets

INTEGRATED TOP DRIVE AND COILED TUBING INJECTOR

CROSS-REFERENCE TO RELATED APPLICATIONS

This application claims the priority of U.S. Provisional Application No. 60/737,611 filed on Nov. 17, 2005, the disclosure of which is incorporated herein by reference for all purposes.

BACKGROUND OF THE INVENTION

1. Field of the Invention

The present invention relates to apparatus for performing earth borehole operations such as drilling and, in particular, to apparatus which can use both coiled tubing and jointed (threaded) pipe.

2. Description of Prior Art

The use of coiled tubing (CT) technology in oil and gas drilling and servicing has become more and more common in the last few years. In CT technology, a continuous pipe wound on a spool is straightened and pushed down a well using a CT injector. CT technology can be used for both drilling and servicing, e.g., workovers.

The advantages offered by the use of CT technology, including economy of time and cost are well known. As compared with jointed-pipe technology wherein typically 30-45 foot straight sections of pipe are threadedly connected one section at a time while drilling the wellbore, CT technology allows the continuous deployment of pipe while drilling the well, significantly reducing the frequency with which such drilling must be suspended to allow additional sections of pipe to be connected. This results in less connection time, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a surface hole using jointed-pipe, cement casing into the surface hole, and then switch over to CT drilling. Additionally, when difficult formations such as gravel are encountered down-hole, it may be necessary to switch from CT drilling to jointed-pipe drilling until drilling through the formation is complete, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed pipe operations is necessary to run casing into the drilled well. In short, in CT drilling operations it is generally necessary for customers and crew to switch back and forth between a CT drilling rig and a jointed-pipe conventional drilling rig, a process which results in significant down-time as one rig is moved out of the way, and the other rig put in place.

Another disadvantage of CT drilling is the time consuming process of assembling a (bottom-hole-assembly (BHA)—the components at the end of the CT for drilling, testing, well servicing, etc.), and connecting the BHA to the end of the CT. Presently, this step is performed manually through the use of rotary tables and make-up/breakout equipment. In some instances, top drives are used but the CT injector and the top drive must be moved out of each others way i.e., they cannot both be in line with the borehole. Not only does this process result in costly downtime, but it can also present safety hazards to the workers as they are required to manipulate heavy components manually.

To address the problems above associated with the use of CT technology and provide for selective and rapid switching from the use of a CT injector to a top drive operation, certain so-called "universal" or "hybrid" rigs have been developed. Typical examples of the universal rigs, i.e., a rig which utilizes a single mast to perform both top drive and CT operations, the top drive and the CT injector being generally at all times operatively connected to the mast, are shown in United States Patent Publication 2004/0206551; and U.S. Pat. Nos. 6,003,598, and 6,609,565. Thus, in U.S. Publication 2004/0206551 there is disclosed a rig adapted to perform earth borehole operations using both CT and/or jointed-pipes, the CT injector and a top drive being mounted on the same mast, the CT injector being selectively moveable between a first position wherein the CT injector is in line with the mast of the rig and hence the earth borehole and a second position wherein the CT injector is out of line with the mast and hence the earth borehole.

In all the systems disclosed in the aforementioned patents, the top drive and the CT injector are two separate units. Accordingly, as disclosed in all of the aforementioned patents, various techniques are disclosed for selectively positioning the CT injector or the top drive over center of the wellbore depending on whether CT operations are being conducted or jointed pipe operations are being conducted.

SUMMARY OF THE INVENTION

In one embodiment of the present invention there is provided an apparatus for conducting earth borehole operations comprising a carrier, base or substructure, a mast mounted on the carrier and an integrated top drive/CT injector unit (integrated unit) mounted on the mast for longitudinal movement therealong. In one aspect, the integrated unit comprises two assemblies, a bottom portion or module which comprises the top drive and an upper portion or module which comprises the CT injector. The bottom module comprising the top drive has an opening therethrough or therealong through which CT from the top module comprising the CT injector can pass when it is desired to conduct CT operations.

In another aspect of the present invention, there is provided an integrated unit as described above further comprising a gooseneck or guide which is releasably connected to the CT injector module of the integrated unit and which can be mounted on the mast and movable between a first position wherein CT passing through the gooseneck can be stabbed into the CT injector module such that the CT issuing therefrom is substantially inline with the axis of the wellbore, and a second position wherein the gooseneck can be moved laterally or rotatably with respect to the integrated unit and hence the mast such that the CT held by the gooseneck is out of line with the axis of the wellbore.

DETAILED DESCRIPTION OF PREFERRED EMBODIMENTS

Figure 1:
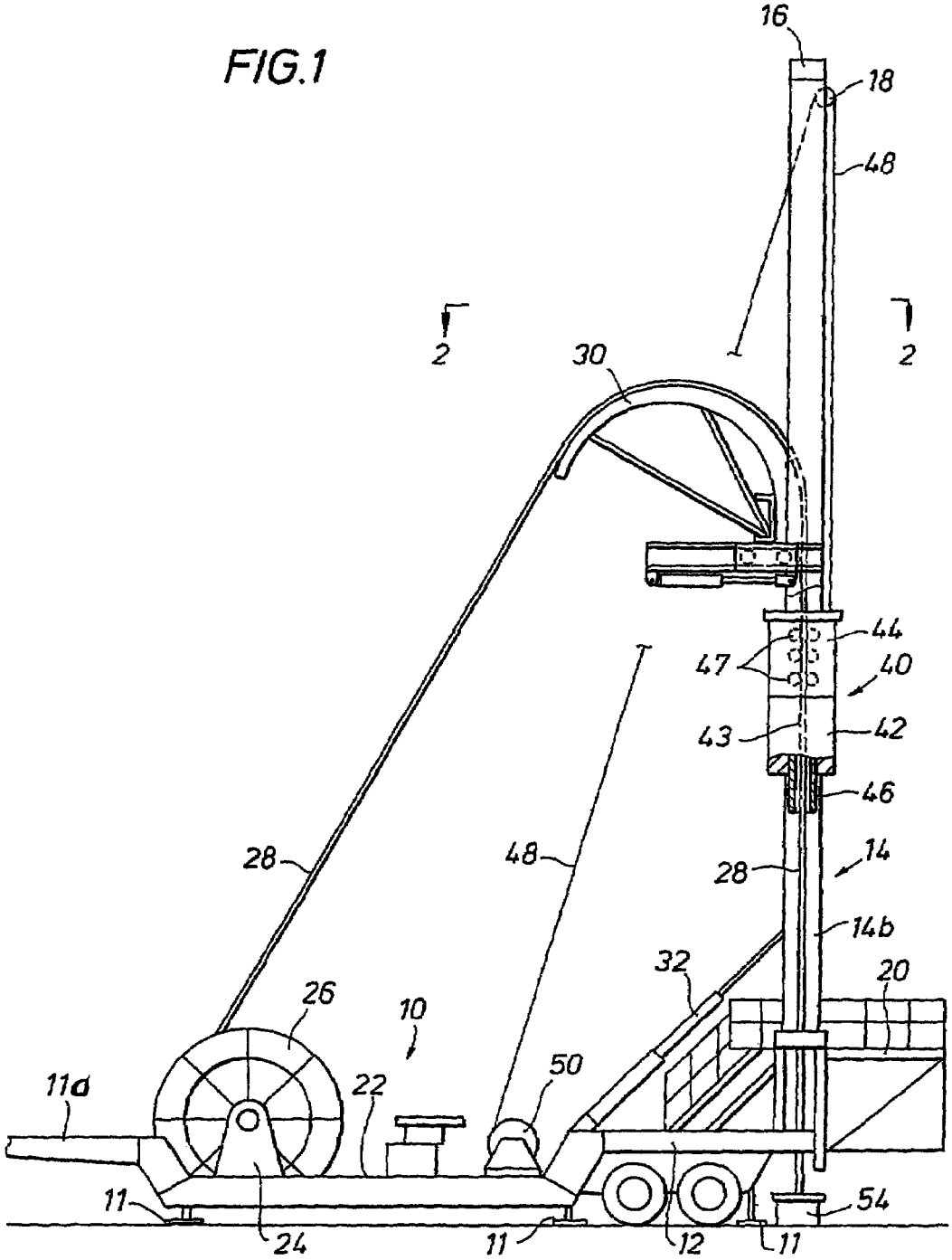
FIG. 1 is an elevational view, partly in section showing one embodiment of the apparatus of the present invention.

Referring first to FIG. 1, a carrier, shown generally as 10 which as shown is of the wheeled variety and includes outriggers 11 for stability, includes a substructure 12 upon which is mounted a mast shown generally as 14, mast 14, as shown in FIG. 1 being generally vertical. In the embodiment shown in FIG. 1, mast 14 is comprised of two spaced columns 14*a* and 14*b*, there being suitable bracing, e.g., struts (not shown) between columns 14*a* and 14*b* to provide structural strength. Columns 14*a* and 14*b* each have attached thereto a rail or track 15 and 17, respectively, which run longitudinally along columns 14*a* and 14*b*, respectively, for a purpose hereinafter described. A crown 16 spans and connects columns 14*a* and 14*b*. Crown 16 carries a crown block assembly 18 comprising sheaves or the like as is well known to those skilled in the art.

Carrier 10 includes a work platform 20 and a sub-platform 22 on which are mounted a pair of pillow blocks 24, only one of which is shown, a reel 26 of CT being journaled in pillow blocks 24. CT 28 played off of reel 26 extends up to and is gripped by a gooseneck/guide 30 for a purpose described more fully hereafter. As is well known, carrier 10 can be of the wheeled variety having a tongue 11*a* for connection to a tractor or the like whereby carrier 10 can be moved from site to site. In this regard, it will be appreciated that mast 14 can pivot from the vertical position shown in FIG. 1 to a generally horizontal position for transport purposes and to this end cylinders 32, only one of which is shown and which are attached to substructure 12, are used to pivot mast 14 from the vertical position shown in FIG. 1 to a horizontal position.

Movably, e.g., slidably, mounted on mast 14 along tracks 15, 17, is an integrated top drive/CT injector unit 40. The integrated unit 40 comprises a lower, top drive module 42 and an upper, CT module 44. As seen with reference to FIGS. 1 and 2, the integrated unit 40 includes guide flanges 15*a*, 15*b* and 17*a*, 17*b*, flanges 15*a*, 15*b* having received therebetween guide rail 15, guide flanges 17*a*, 17*b* having received therebetween guide rail 17. Thus, integrated unit 40 can move longitudinally along columns 14*a* and 14*b*. Additionally, guide flanges 15*a*, 15*b*, 17*a* and 17*b* in cooperation with guide rails 15 and 17 serve to offset reaction torque on the integrated unit 40 caused by rotation of tubular members being driven by top drive module 42. The construction and operation of top drives and CT injectors are well known to those skilled in the art and need not be described in detail here. Suffice to say that the top drive module 42 is provided with a rotatable threaded spindle 46 for connection to the threaded box of a tubular member such as drill pipe, casing, etc., whereby the tubular member can be moved vertically as well as rotatably. The CT injector module 44 is provided with grippers/rollers 47 which can be used to either force the CT 28 downwardly or exert an upward pull.

Integrated unit 40 is integrated in the sense that the top drive module 42 and the CT injector module 44 are not separate units but are mechanically joined to one another and move in unison longitudinally along the mast 14. To accomplish such movement, one or more cables 48 attached to integrated unit 40 run through the crown sheaves 18 to a draw works 50 mounted on platform 22. In this manner, by operation of draw works 50, integrated unit 40 can be moved longitudinally along mast 14. In the embodiment shown in FIG. 1, it can be seen that the CT 28 is stabbed into CT injector module 44, and extends through top drive portion 44 downwardly through a wellhead 54 into a wellbore (not shown). Thus, FIG. 1 depicts the situation where the top drive module 42 is inoperative and the CT injector module 44 is being used.

Figure 2:
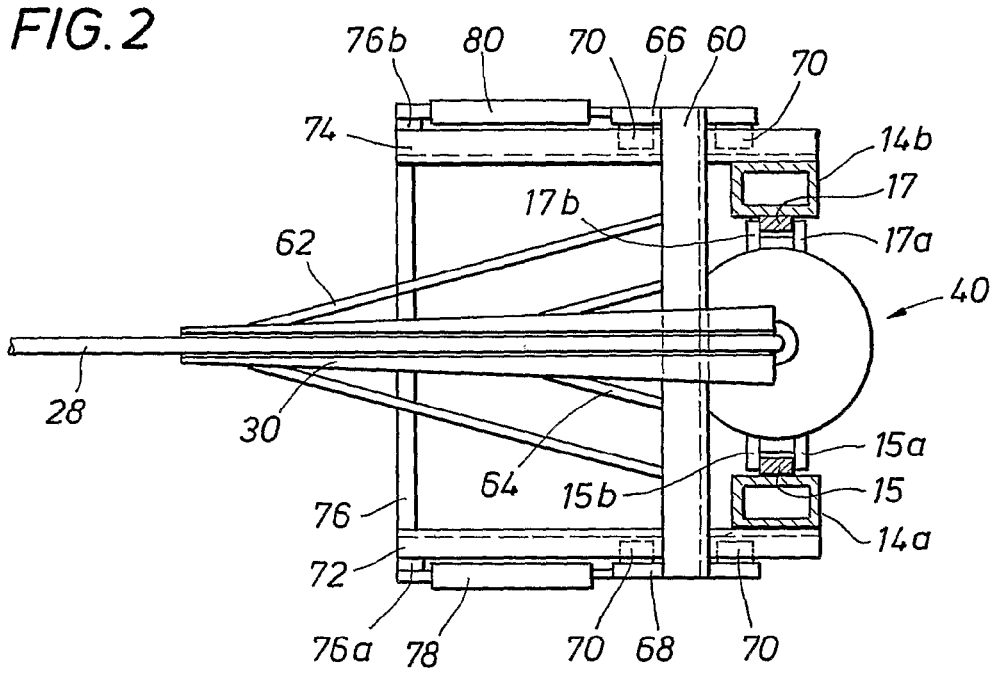
FIG. 2 is a cross-sectional view taken along the lines 2-2 of FIG. 1.

With reference to FIGS. 1 and 2, it can be seen that guide 30 is secured to a frame comprised of a cross channel beam 60, braces 62 and 64 being secured to the body of guide 30 and to beam 60. Beam 60 in turn is secured to a pair of spaced roller mounts 66 and 68. Rotatably journaled in roller mounts 66 and 68 are rollers 70, a first pair of rollers being in roller mount 66 a second pair of rollers being in roller mount 68. A first channel member 72 is secured to column 14*a* while a second channel member 74 is secured to column 14*b*. Channel member 72 and 74 extend transversely, e.g., perpendicular, to mast 14 and form a pair of spaced tracks. A cross member 76 connects the ends of the channel members 72 and 74. Secured to the cross member 76 is a first piston cylinder combination 78, a second piston cylinder combination 80 being secured to the opposite end of cross member 76. As can be seen by comparison of FIGS. 1-3, the cylinder portions of piston/cylinder combinations 78 and 80 are secured to the ends 76*a* and 76*b*, respectively, of the cross member 76 while the piston rods are connected to the roller mounts 68 and 66, respectively. Thus, the piston rod of piston cylinder combination 80 is connected to roller mount 66 while the piston of piston cylinder combination 78 is connected to roller mount 68. While not shown, the piston cylinder combination 78, 80 are connected to a suitable source of hydraulic power whereby the piston rods of the respective piston/cylinder combinations 78, 80 can be extended and retracted. In the position shown in FIGS. 1 and 2, the piston rods of the piston cylinder combinations 78 and 80 are extended and in that position guide 30 is positioned relative to integrated unit 40 such that CT 28 can be stabbed into CT injector module 44 and thereby be in line with the wellbore extending from wellhead 54. As noted above, in this position, CT injector module 44 is operative to inject into or withdraw CT 28 from the wellbore above which wellhead 54 is mounted.

Figure 4:
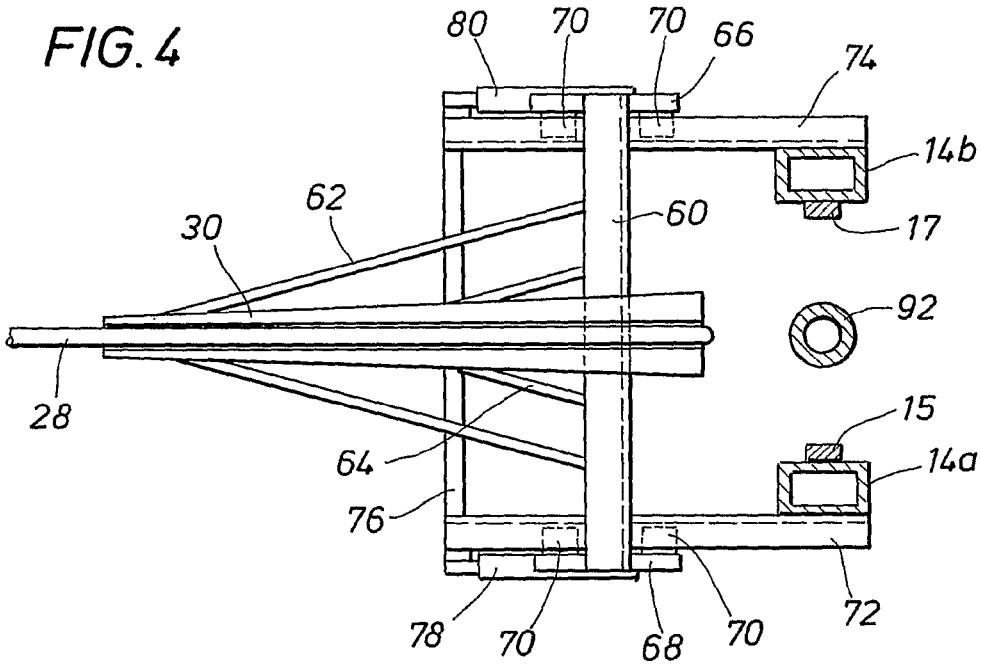
FIG. 4 is a cross-sectional view taken along the lines 4-4 of FIG. 3.
Figure 3:
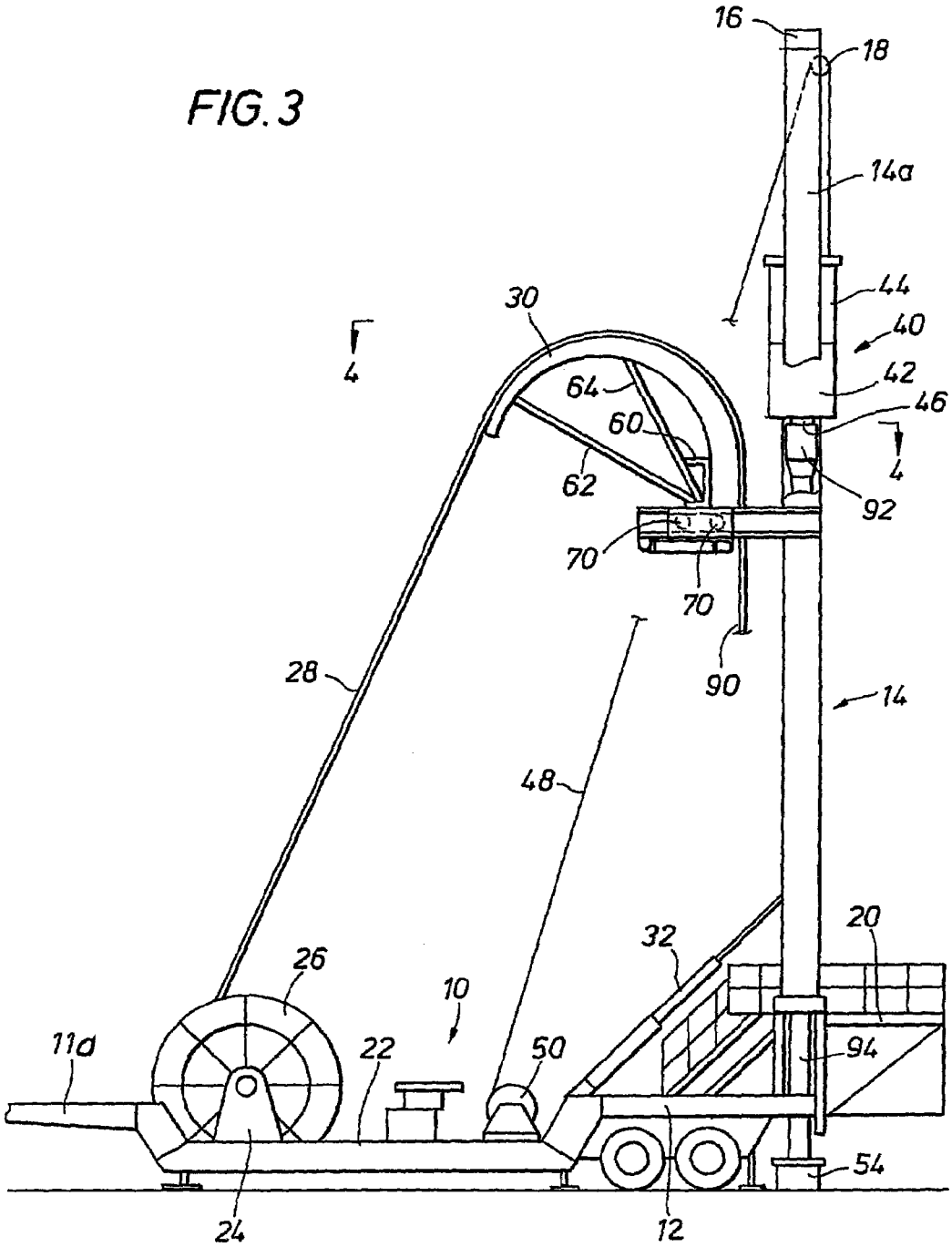
FIG. 3 is an elevational view of the apparatus shown in FIG. 1 with the gooseneck or guide disconnected from the CT injector.

Reference is now made to FIGS. 3 and 4 which depicts the operation of the apparatus of the present invention wherein top drive module 42 is being used in jointed pipe operations. As noted above, channel members 72 and 74 form unshaped tracks which are generally transverse to the mast 14. Rollers 70 mounted to roller mounts 66 and 68 engage the channel shape members 72 and 74 such that by extending and retracting the pistons of piston cylinder combination 78, 80, the frame carrying guide 30 can be moved laterally with respect to mast 14. Thus, and as clearly shown in FIGS. 3 and 4, when the pistons of piston cylinder combination 78 and 80 are retracted, beam 70 and the associated structural members forming the frame for CT guide 30 move to the position shown in FIGS. 3 and 4 and, as best seen in FIG. 3 in this position, the CT 28 is now moved to a position where it is no longer in line with the wellbore above which wellhead 54 is mounted. It will be understood that to accomplish this movement of guide 30, and when the apparatus is in the position shown in FIG. 1, the integrated unit 40 would be moved downwardly to release the CT from CT injector 44 thus leaving a free end 90 as shown in FIG. 3. It will be understood that guide 30 will be provided with a selectively operable locking or gripping mechanism which can grip and/or hold CT 28 in the position shown in FIG. 3, i.e., with a free end 90 extending from guide 30. Such a gripping mechanism accomplishes at least two purposes:

(a) it maintains a free end 90 of CT 28 that can be easily stabbed into CT injector module 44; and (b) it prevents the CT 28 from snapping back towards and/or unreeling from reel 26 which would be extremely dangerous to personnel on or about the rig and could as well cause damage to the equipment.

Once the CT has been removed from the CT module 44 as depicted in FIGS. 3 and 4, the top drive module 42 is then free to conduct operations with jointed pipe. In this regard, it can be seen with reference to FIG. 3, that spindle 46 has been threaded into the box 92 of a tubular 94 which could be drill pipe, casing or any other oilfield tubular, or for that matter a threaded tool which in turn is connected to other downhole tubular and associated tools as desired. Thus, it will be understood that in the position shown in FIG. 3, the integrated unit 40 is now in the position to run oilfield tubulars, e.g., tubular 94, into and out of the wellbore through wellhead 54. Although not shown, it will be understood that oilfield tubulars 94 would be picked up from a V-door or the like by an elevator well known in the art and that substructure 12 could include a rotary table such that the tubular 94, suspended by the elevator (not shown) could be fixed against rotation while the threaded spindle 46 engaged the threaded box 92. Also, as is well known in the art, when using jointed pipe such as oilfield tubular 94, successive joints are connected to achieve the desired string length.

Figure 5:
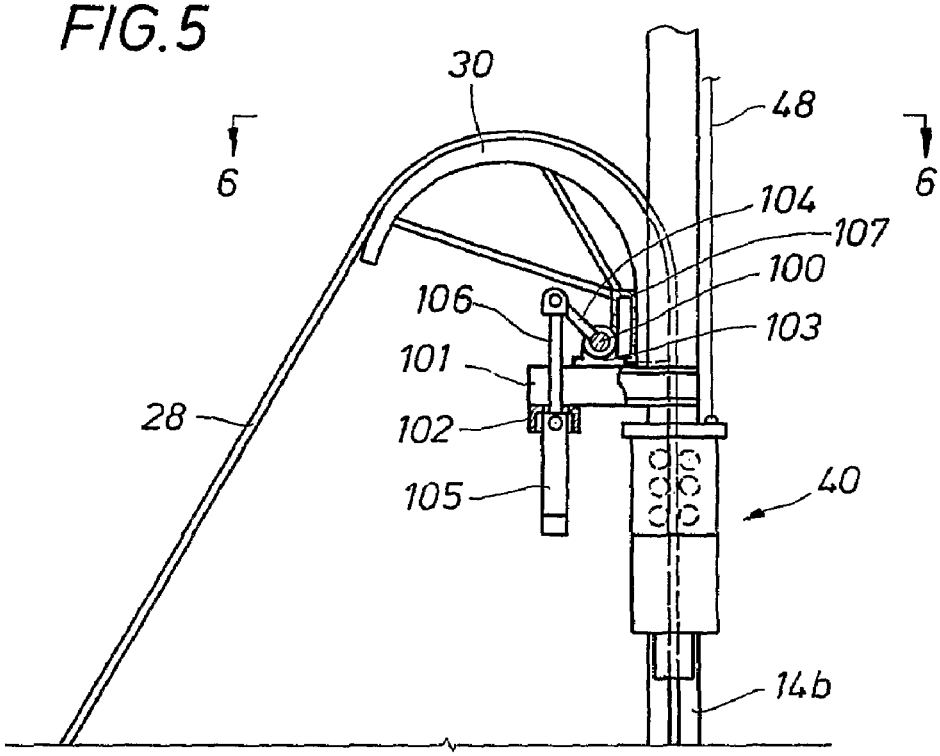
FIG. 5 is an elevational view showing another embodiment of the apparatus of FIG. 1 with the gooseneck or guide connected to the CT injector.
Figure 6:
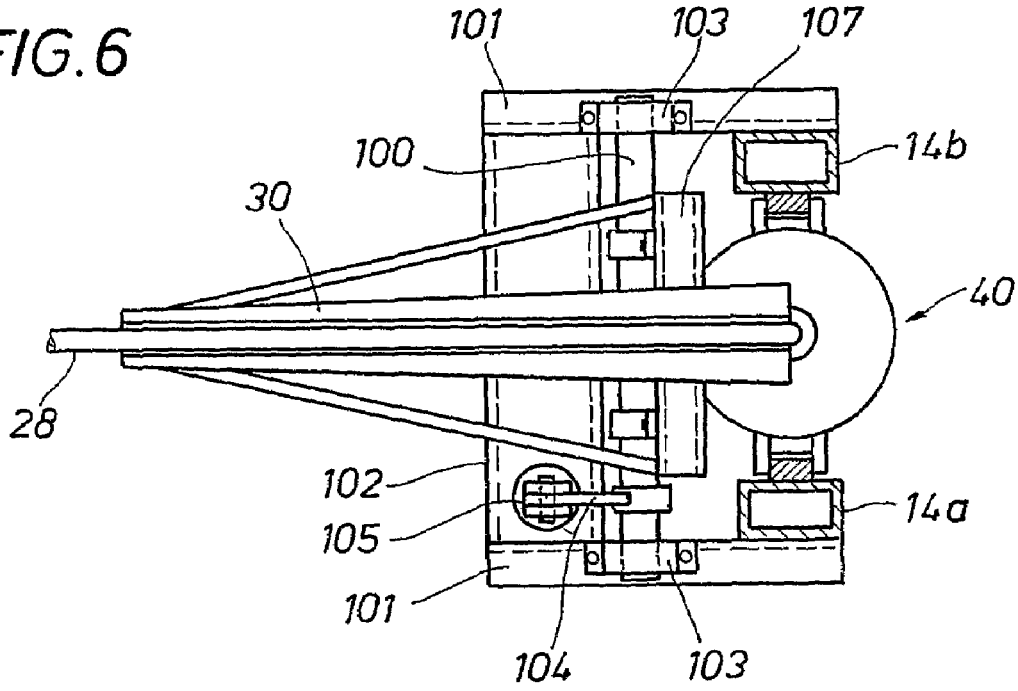
FIG. 6 is a cross-sectional view taken along the lines 6-6 of FIG. 5.

Turning now to FIGS. 5 and 6, there is shown another embodiment of the present invention wherein the guide 30, instead of being laterally movable relative to the mast as depicted in FIGS. 1-4, is connected to the mast in such a way that it can be pivoted or rotated from a position wherein CT issuing from the guide 30 is in line with the CT injector 44 such that it can be stabbed into CT injector 44 to a second position wherein the CT 28 is out of alignment with the CT injector 44 and is basically transverse to the mast 14. As seen in FIGS. 5 and 6, there are a pair of support arms 101 which are secured to columns 14*a* and 14*b* and extend laterally therefrom. Secured to support arms 101 at their ends distal columns 14*a* and 14*b* is a cross brace 102 in the form of a channel, the support arms 101 and cross brace 102 forming a frame. Secured to cross brace 102 is a piston cylinder combination 106/105 which can be hydraulic as is well understood by those skilled in the art. The piston rod 106 is connected by a clevis to an arm or crank 104 which is rotatable relative to the clevis and is fixedly secured on its opposite end to a shaft 100. Shaft 100 is in turn fixedly secured to box tubing 107 which in turn is fixedly secured to the underside of guide 30, shaft 100 being rotatably journaled in pillow blocks 103.

In the depiction shown in FIGS. 5 and 6, guide 30 is connected to CT injector 44 such that CT 28 is aligned with CT injector 44 to the extent that CT 28 can be fed into injector 40 and subsequently into the wellhead 54 above the wellbore. In this regard, in the depiction of FIGS. 5 and 6, the CT 28 issuing from CT injector 44 is generally in line with the wellbore below the wellhead 54. As in the case discussed above with the embodiments of FIGS. 1-4, the guide 30 is selectively, releasably connected to CT injector 44 and when in the connected condition, CT injector 44 can perform typical CT activities, e.g., drilling, workovers, etc. When it is desired that top drive 42 be used for jointed pipe activities or the like, it is typically necessary to detach guide 30 from CT injector 44. This can easily be accomplished with the embodiment shown in FIGS. 5-8.

Figure 7:
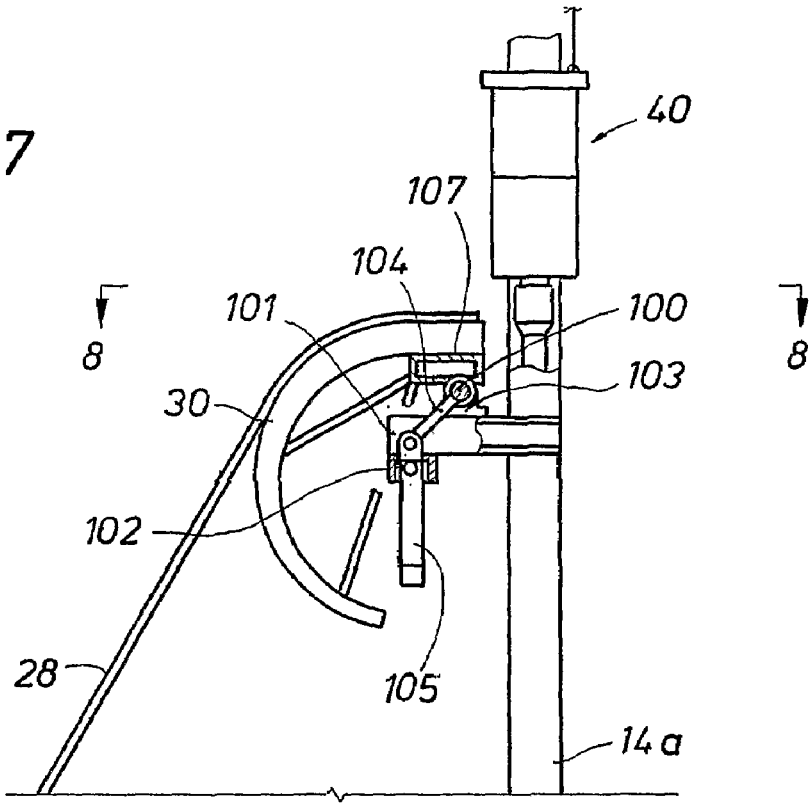
FIG. 7 is a view similar to FIG. 5 but showing the gooseneck or guide disconnected from the CT injector.
Figure 8:
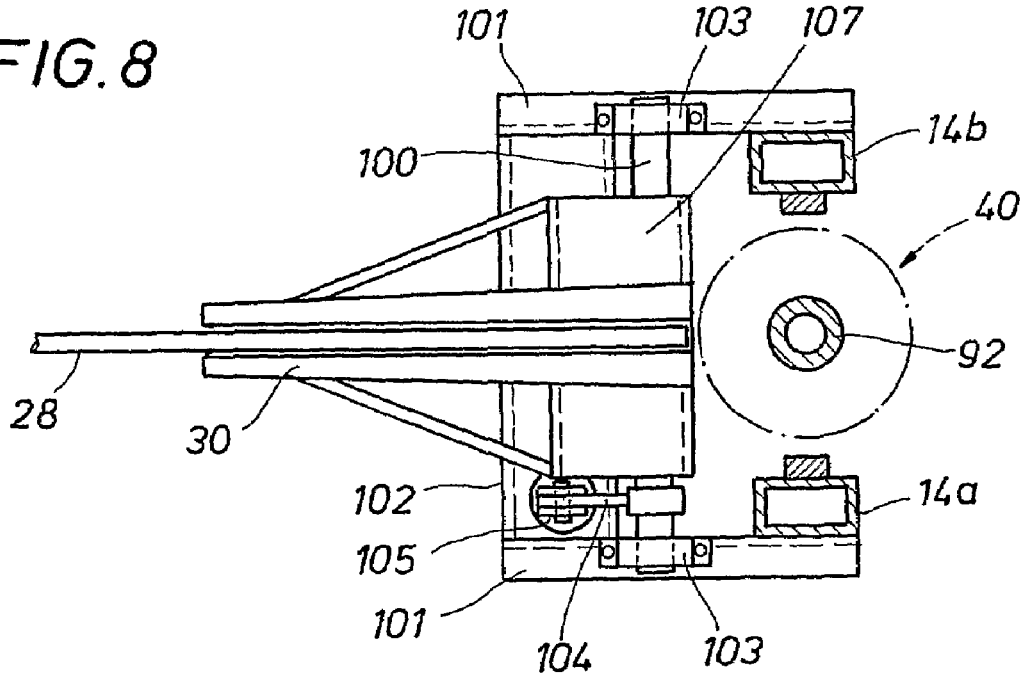
FIG. 8 is a cross-sectional view taken along the lines 8-8 of FIG. 7.

Turning now to FIGS. 7 and 8, the guide 30 is shown as being removed from CT injector 44 and CT injector 44 and top drive 42 moved upwardly relative to the position shown in FIGS. 5 and 6. To detach guide 30 from CT injector 44, piston rod 106 is retracted into cylinder 105 which moves arm or crank 104 downwardly. Since the end of crank 104 distal the end connected to the connection to the piston 106 is fixed to shaft 100, and since shaft 100 is in turn fixed to box frame 107, as arm 104 rotates about the clevis connection connecting arm 104 and piston rod 106, box tubing 107 and hence guide 30, also rotate about an axis determined by shaft 100. Thus, when fully rotated to the position shown in FIG. 7, CT 28 has its free end generally transverse to mast 14. Additionally as can be seen in FIG. 7 with guide 30 rotated as shown, the integrated unit 40 of CT injector 44 and top drive 42 can now be moved freely longitudinally along mast 14.

As described above with respect to the embodiments shown in FIGS. 1-4, it will be understood that guide 30 will be provided with a suitable gripping mechanism or locking mechanism which maintains the free end of CT in guide 30 so that it can be easily stabbed into CT injector 44 when necessary and it also prevents CT 28 from snapping back towards and/or unreeling from reel 26. Also as shown in FIGS. 1-4, once guide 30 has been rotated to the position shown in FIGS. 7 and 8, top drive module 42 is then free to conduct operation with jointed pipe or for any other use that is appropriate.

It will be appreciated that carrier 10 can be self-propelled. Furthermore, the carrier can comprise a stationary structure as, for example, a skid or the like, which can be raised and placed on a trailer or other transport vehicle for movement to another site if desired. It will also be appreciated that the apparatus of the present invention can be mounted on an offshore platform via a skid or other substructure on which the mast and other components are mounted. As noted above, the top drive module 42 is provided with a longitudinal opening 43 extending therethrough for passage of the CT 28. Obviously, the integrated unit could be designed such that top drive module 42 was slotted so that rather than a longitudinal opening being provided in the top drive unit 42, the CT 28 would pass through the slot in the top drive module 42.

Although not shown, it will be understood that the integrated unit 40 could be carried on a suitable cradle or the like attached to the cables 48 for movement of the integrated unit 40 longitudinally along the mast 14.

While it is conceivable that the integrated unit 40 could have a monolithic housing, for purposes of servicing the respective modules, typically the top drive module 42 and the CT module 44 would be separate, connected housings which would permit selective access to one of the modules as desired. It will also be understood that suitable structural members can connect the top drive module 42 with the CT module 44 in such a manner that they move as a one piece unit. The term "integrated" as used with respect to the integrated CT injector/top drive of the present invention is intended to encompass a structure be it monolithic, separate, attached modules or the like which, whatever the form, can be moved longitudinally along the mast as a single unit as opposed to the CT injector and the top drive being independently movable with respect to one another along the mast. Further, although the integrated unit of the present invention has been described with respect to the CT module or portion being above the top drive module or portion, it is within the scope of the present invention that the relative positions of the CT injector and the top drive could be reversed, e.g., with the top drive above the CT injector. While such a configuration presents greater difficulties from an engineering standpoint, it would nonetheless be possible to construct such an integrated unit. One of the advantages of the integrated unit of the present invention is the fact that the CT injector and the top drive could share common components, e.g., hydraulic systems, planetary gear systems, and other pneumatic, hydraulic or mechanical systems which are or could be used either in a CT injector or a top drive.

It can be seen that the present invention provides a unique, universal rig which can selectively handle and run different types of pipe, CT, and other earth borehole equipment thereby eliminating the need for two rigs—one rig to use a top drive in the conventional manner and a separate CT injector unit to perform CT operations.

As described above, the guide 30 can be mounted either on a trolley or carriage which moves along tracks transverse to and affixed to columns 14*a* and 14*b* of mast 14 or on a frame attached to mast 14 which allows guide 30 to pivot or rotate as described. In this manner, the guide 30 can be selectively, laterally or rotatably moved relative to the mast, e.g., from a first position where the guide can be attached to the CT injector and the free end 90 of the CT 28 can be stabbed into the CT module 44 when CT operations are employed to a second position where, once the CT is removed from the CT module 44, the CT from the guide will be out of alignment with the CT module 44 so as to permit the top drive module 42 to perform jointed pipe operations.

It will also be apparent that the guide 30 need not be mounted on a trolley/track or rotation system secured to the mast. For example, a separate crane, e.g., jib crane, could be used to hold the guide 30 in a position such is shown in FIG. 3 wherein the free end of the CT 90 is not stabbed into the CT module 44 or alternatively in the position shown in FIG. 1 when the CT 28 is stabbed into the CT module 44. In this regard, when a separate crane or other lifting device was employed to position the guide such that the CT could be stabbed into the CT module 44, the carrier 10 need not be a single vehicle, platform or the like. Rather, the CT reel 26 with the guide 30 could be on a separate trailer, carrier or the like, whereas the mast carrying the integrated unit 40 could be on yet another trailer, carrier or the like. Additionally, the crane could be in the form of a gin pole or telescoping arms that were mounted on a separate trailer which carried the reel of CT and the guide and which could be used to raise the guide 30 and position it such that the CT could be stabbed into the CT module 44.

The foregoing description and examples illustrate selected embodiments of the present invention. In light thereof, variations and modifications will be suggested to one skilled in the art, all of which are in the spirit and purview of this invention.

What is claimed is:

1. An apparatus for conducting earth borehole operations comprising:

a base;

a mast mounted on the base;

an integrated unit comprising a top drive and a coiled tubing (CT) injector carried by said mast for simultaneous, longitudinal movement therealong, said CT injector being above said top drive, said top drive having an opening therethrough whereby coiled tubing from said injector can pass through said top drive; and a guide for CT, said guide being selectively releasably connected to said CT injector, said guide being mounted on said mast and selectively movable between a first position wherein CT from said guide can be stabbed into said CT injector while said CT injector is in said mast and a second position wherein CT from said guide is out of alignment with said CT injector while said CT injector is in said mast.

2. The apparatus of claim 1, wherein said guide is mounted on said mast for lateral movement relative to said mast said first position and said second position.

3. The apparatus of claim 1, wherein said guide is mounted on said mast for pivotable movement between a first position wherein CT from said guide can be stabbed into said CT injector to a second position wherein said CT from said guide is substantially transverse to said mast.

4. The apparatus of claim 2, wherein said guide is mounted on a frame, said frame being movably mounted on tracks connected to said mast whereby said frame can move laterally with respect to said mast.

* * * * *